US009147504B2

(12) United States Patent
Kusakari et al.

(10) Patent No.: US 9,147,504 B2
(45) **Date of Patent: *Sep. 29, 2015**

(54) ALUMINUM ALLOY WIRE

(71) Applicants: SUMITOMO ELECTRIC INDUSTRIES, LTD., Osaka-shi, Osaka (JP); AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC TOYAMA CO., LTD., Imizu-shi, Toyama (JP)

(72) Inventors: Misato Kusakari, Osaka (JP); Yoshihiro Nakai, Osaka (JP); Taichirou Nishikawa, Osaka (JP); Yoshiyuki Takaki, Osaka (JP); Yasuyuki Ootsuka, Yokkaichi (JP)

(73) Assignees: SUMITOMO ELECTRIC INDUSTRIES, LTD., Osaka (JP); AUTONETWORKS TECHNOLOGIES, LTD., Mie (JP); SUMITOMO WIRING SYSTEMS, LTD., Mie (JP); SUMITOMO ELECTRIC TOYAMA CO., LTD., Toyama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/720,496

(22) Filed: Dec. 19, 2012

(65) Prior Publication Data

US 2013/0126231 A1 May 23, 2013

Related U.S. Application Data

(62) Division of application No. 13/058,257, filed as application No. PCT/JP2009/002651 on Jun. 11, 2009, now Pat. No. 8,353,993.

(30) Foreign Application Priority Data

Aug. 11, 2008 (JP) ..... 2008-206726
Aug. 11, 2008 (JP) ..... 2008-206728
Mar. 23, 2009 (JP) ..... 2009-069791

(51) Int. Cl.

| | |
|---|---|
| ***H01B 1/02*** | (2006.01) |
| ***C22C 21/00*** | (2006.01) |
| ***B21C 1/00*** | (2006.01) |
| ***C22F 1/00*** | (2006.01) |
| ***C22F 1/02*** | (2006.01) |
| ***C22F 1/04*** | (2006.01) |

(52) U.S. Cl.
CPC *H01B 1/023* (2013.01); *B21C 1/00* (2013.01); *C22C 21/00* (2013.01); *C22F 1/00* (2013.01); *C22F 1/02* (2013.01); *C22F 1/04* (2013.01)

(58) Field of Classification Search
CPC ..... H01B 1/023; C22F 1/04; C22C 21/00; B21C 1/00
See application file for complete search history.

(56) References Cited

U.S. PATENT DOCUMENTS

| | | | | |
|---|---|---|---|---|
| 3,513,250 | A | 5/1970 | Schoerner | |
| 3,647,939 | A * | 3/1972 | Schoerner | 174/128.1 |
| 3,697,260 | A | 10/1972 | Hunsicker | |
| 3,807,969 | A * | 4/1974 | Schoerner et al. | 420/537 |
| 3,842,185 | A * | 10/1974 | Raw et al. | 174/23 R |
| 3,920,411 | A * | 11/1975 | Schoerner et al. | 420/550 |
| 3,958,987 | A * | 5/1976 | Chia et al. | 420/548 |
| 3,984,619 | A | 10/1976 | Raw et al. | |
| 4,080,223 | A * | 3/1978 | Schoerner et al. | 148/550 |
| 8,278,555 | B2 * | 10/2012 | Otsuka et al. | 174/126.1 |
| 8,353,993 | B2 * | 1/2013 | Kusakari et al. | 148/440 |
| 8,476,529 | B2 * | 7/2013 | Otsuka et al. | 174/126.1 |
| 2003/0111256 | A1 | 6/2003 | Fujiwara | |
| 2004/0079457 | A1 | 4/2004 | Kimura et al. | |
| 2008/0196923 | A1 | 8/2008 | Susai et al. | |

FOREIGN PATENT DOCUMENTS

| | | | |
|---|---|---|---|
| CA | 1037742 | A1 | 9/1978 |
| DE | 2435456 | A1 | 2/1975 |
| DE | 155435 | A1 | 6/1982 |
| EP | 1 852 875 | A1 | 11/2007 |

| | | | | |
|---|---|---|---|---|
| GB | 1 475 587 | A | | 6/1977 |
| JP | 51-039559 | A | | 4/1976 |
| JP | 51039559 | A | * | 4/1976 |
| JP | 52-011112 | A | | 1/1977 |
| JP | 53-135811 | A | | 11/1978 |
| JP | 2001-254160 | A | | 9/2001 |
| JP | 2003-321755 | A | | 11/2003 |
| JP | 2005-336549 | A | | 12/2005 |
| JP | 2006-019163 | A | | 1/2006 |
| JP | 2006-253109 | A | | 9/2006 |
| WO | WO2009054457 | A | * | 4/2009 |

OTHER PUBLICATIONS

German Office Action, w/ English translation of relevant parts, issued in German Patent Application No. 11 2009 001 986.2 dated Apr. 12, 2012.

Verdrillung. In: Wikipedia, Die freie Enzyklopadie. URL:http://de.wikipedia.org/wikiNerdrillung, archived under http://www.archive.org on Sep. 13, 2006 [downloaded on Apr. 11, 2012].

"Structures and Properties of Aluminum", Japan Institute of Light Metals, Nov. 30, 1991 (with English translation).

"Aluminum Handbook (7th Edition)", Japan Aluminum Association, Jan. 31, 2007, pp. 26, 32, 37 (with English translation).

* cited by examiner

*Primary Examiner* — Roy King
*Assistant Examiner* — Janelle Morillo

(74) *Attorney, Agent, or Firm* — McDermott Will & Emery LLP

(57) ABSTRACT

An aluminum alloy, an aluminum alloy wire, an aluminum alloy stranded wire, a covered electric wire, and a wire harness that are of high toughness and high electrical conductivity, and a method of manufacturing an aluminum alloy wire are provided. The aluminum alloy wire contains not less than 0.005% and not more than 2.2% by mass of Fe, and a remainder including Al and an impurity. It may further contain not less than 0.005% and not more than 1.0% by mass in total of at least one additive element selected from Mg, Si, Cu, Zn, Ni, Mn, Ag, Cr, and Zr. The Al alloy wire has an electrical conductivity of not less than 58% IACS and an elongation of not less than 10%. The Al alloy wire is manufactured through the successive steps of casting, rolling, wiredrawing, and softening treatment. The softening treatment can be performed to provide an excellent toughness such as elongation and impact resistance and thereby reduce fracture of the electric wire in the vicinity of a terminal portion when the wire harness is installed.

6 Claims, 3 Drawing Sheets

(1) BATCH SOFTENING TREATMENT (2) CONTINUOUS SOFTENING TREATMENT

ALUMINUM ALLOY WIRE

RELATED APPLICATIONS

This application is a Divisional of U.S. Pat. No. 8,353,993, filed Feb. 9, 2011, which is the U.S. National Phase under 35 U.S.C. §371 of International Application No. PCT/JP2009/002651, filed on Jun. 11, 2009, which in turn claims the benefit of Japanese Application Nos. 2008-206726, 2008-206728, both filed on Aug. 11, 2008, and 2009-069791, filed on Mar. 23, 2009, the disclosures of which Applications are incorporated by reference herein.

TECHNICAL FIELD

The present invention relates to an aluminum alloy wire and an aluminum alloy stranded wire used as a conductor of an electric wire, a covered electric wire having the alloy wire or the alloy stranded wire as a conductor, a wire harness including the covered electric wire, a method of manufacturing the alloy wire, and an aluminum alloy. In particular, the present invention relates to an aluminum alloy wire having well-balanced characteristics (strength, toughness, electrical conductivity) suitable for a conductor for an electric wire of a wire harness that is used for a transportation device such as motor vehicle.

BACKGROUND ART

Conventionally, for wiring structures of transportation devices such as motor vehicle and airplane and of industrial devices such as robot, a structure in the form called wire harness including a plurality of bound electric wires with terminals has been used. Conventionally, the material to constitute a conductor for an electric wire of the wire harness is mostly copper having an excellent electrical conductivity or a copper-based material such as copper alloy.

With the recent rapid enhancement in performance and capabilities of the motor vehicle and with the increase of a variety of electrical devices, control devices and the like that are mounted on the vehicle, electric wires used for these devices also tend to increase. Meanwhile, recently for the sake of environmental conservation, improved fuel economy of motor vehicles and airplanes for example has been desired. A reduced weight can improve the fuel economy. In view of this, for the purpose of reduction in weight of electric wires, studies are conducted on use, as a conductor, of aluminum having its specific gravity which is about one-third that of copper. For instance, there has been an example where pure aluminum is used for a conductor for an electric wire of 10 $mm^2$ or more such as a battery cable of a motor vehicle. Pure aluminum, however, has a lower strength and a lower fatigue resistance than a copper-based material, and therefore, pure aluminum is difficult to be applied to common conductors for electric wires such as those having a conductor's cross-sectional area of 1.5 $mm^2$ or less. In contrast, Patent Document 1 discloses an aluminum alloy wire used as a conductor for an electric wire of a wire harness for a motor vehicle that is made of an aluminum alloy having a higher strength than pure aluminum.

PRIOR ART DOCUMENTS

Patent Documents

Patent Document 1: Japanese Patent Laying-Open No. 2005-336549

SUMMARY OF THE INVENTION

Problems to be Solved by the Invention

The conventional aluminum alloy wire, however, does not adequately have required characteristics for a wire harness disposed in a transportation device such as motor vehicle.

A higher electrical conductivity is desired for a conductor for an electric wire. The aluminum alloy wire disclosed in Patent Document 1, however, does not have a sufficiently high electrical conductivity.

Further, an aluminum alloy electric wire with a high strength like the one disclosed in Patent Document 1 has an insufficient toughness. Conventionally, studies have been conducted on an aluminum alloy to constitute a conductor for an electric wire of a wire harness in a motor vehicle, mainly with the purpose of improving the strength, and the studies are insufficient in terms of the toughness (such as impact resistance and elongation). The inventors of the present invention have conducted studies to make a finding that, when a wire harness for which a high-strength aluminum alloy electric wire as disclosed in Patent Document 1 is used is installed in a device or the like, the conductor could be ruptured in the vicinity of the boundary between the conductor and a terminal portion. In other words, while studies have been conducted conventionally on the characteristics of the wire itself, the studies have not been conducted on the characteristics when the wire is applied to a wire harness including a terminal portion. A wire harness having a sufficient toughness required at the time of being installed has not been developed.

The terminal portion is attached in such a manner that enables a desired electrically conductive state to be maintained. A finding, however, has been made as follows. In the conventional aluminum alloy wire, the stress at the time of the attachment is relaxed (stress decreases with time), which results in decrease in securing strength between the electric wire and the terminal portion and could result in dropping off of the terminal portion from the electric wire. Namely, regarding the electric wire for which the conventional aluminum alloy wire is used, the attached terminal portion could loosen. It is therefore desired to develop a wire harness in which the securing strength between an electric wire and a terminal portion is high.

In view of the foregoing, an object of the present invention is to provide an aluminum alloy wire and an aluminum alloy stranded wire having a high strength, a high toughness, and a high electrical conductivity and suitable for a conductor for an electric wire of a wire harness, as well as a covered electric wire suitable for a wire harness. Another object of the present invention is to provide a wire harness including an electric wire with a high strength, a high toughness, and a high electrical conductivity. Still another object of the present invention is to provide a method of manufacturing the above-described aluminum alloy wire of the present invention.

Means for Solving the Problems

Having studied an aluminum alloy wire of a high electrical conductivity that sufficiently has characteristics desired for a wire harness, particularly such as impact resistance and securing strength between the wire and a terminal portion, and is suitable for a conductor for an electric wire, the inventors of the present invention have made a finding that it is preferable to use a softened material having undergone a softening treatment after (which may not necessarily be immediately after) being wiredrawn. The softening treatment can improve not only the elongation of the wire but also the electrical conductivity by removing strain resulting from plastic working such as wiredrawing. The inventors have also made a finding that an aluminum alloy wire that can be improved in impact resistance and securing strength between the wire and a terminal portion and is also excellent in strength can be obtained by performing the softening treatment and additionally defining an aluminum alloy as having a specific composition, specifically by defining an aluminum alloy as containing a specific amount of Fe. The present invention has been made based on these findings as described above.

A method of manufacturing an aluminum alloy wire of the present invention includes the following steps.

1. The step of forming a cast material by casting a molten aluminum alloy containing not less than 0.005% and not more than 2.2% by mass of Fe and a remainder including Al.

2. The step of forming a rolled material by performing rolling on the cast material.

3. The step of forming a wiredrawn material by performing wiredrawing on the rolled material.

4. The step of forming a softened material by performing softening treatment on the wiredrawn material.

The manufacturing method of the present invention performs the softening treatment on the wiredrawn material so that the wire after being softening-treated has an elongation of not less than 10%. The aluminum alloy wire thus obtained is used as a conductor.

The above-described manufacturing method provides the aluminum alloy wire of the present invention. The aluminum alloy wire of the present invention is used as a conductor, and contains not less than 0.005% and not more than 2.2% by mass of Fe and a remainder including Al and an impurity. This aluminum alloy wire (hereinafter referred to as Al alloy wire) has an electrical conductivity of not less than 58% IACS and an elongation of not less than 10%.

Since the Al alloy wire of the present invention is a softened material having undergone softening treatment, the wire is excellent in both of the electrical conductivity and the toughness, and has a high connection strength with a terminal portion. Further, since the Al alloy wire of the present invention has a specific composition, it also has a high strength. Therefore, the Al alloy wire of the present invention adequately has the electrical conductivity, the impact resistance, the strength, and the connectivity with a terminal portion that are desired for a wire harness, and can suitably be used as a conductor for an electric wire of a wire harness. In the following, the present invention will be described in more detail. Here, the content of an element is expressed in mass %.

[Al Alloy Wire]

<<Composition>>

An Al alloy of the present invention to constitute an Al alloy wire of the present invention is an Al—Fe-based alloy containing not less than 0.005% and not more than 2.2% of Fe. Containing of not less than 0.005% of Fe can provide the Al alloy wire that is excellent in strength. While a higher content of Fe allows the Al alloy to have a higher strength, it also allows the Al alloy to have a lower electrical conductivity and a lower toughness, and causes wire breakage to be more likely to occur during wiredrawing for example. The content of Fe is therefore set to not more than 2.2%. Although Fe can improve the strength without significantly lowering the electrical conductivity, an excessively high content of added Fe results in degradation in workability of wiredrawing for example. A more preferred content of Fe is not less than 0.9% and not more than 2.0%.

In addition to Fe, at least one additive element selected from Mg, Si, Cu, Zn, Ni, Mn, Ag, Cr, and Zr can be contained to make improvements in strength, toughness, and impact resistance. While Mn, Ni, Zr, and Cr cause a large reduction in electrical conductivity, they are highly effective in improvement of the strength. Ag and Zn cause less reduction in electrical conductivity and are effective to a certain extent in improvement of the strength. Cu causes less reduction in electrical conductivity and can improve the strength. While Mg causes a large reduction of the electrical conductivity, Mg is highly effective in improvement of the strength. In particular, Mg contained simultaneously with Si can further improve the strength. Of these additive elements, a single element or a combination of at least two elements may be contained, and preferably the total content is not less than 0.005% and not more than 1.0% by mass. Preferred contents are not less than 0.05% and not more than 0.5% of Mg, not less than 0.005% and not more than 0.2% in total of Mn, Ni, Zr, Zn, Cr, and Ag, not less than 0.05% and not more than 0.5% of Cu, and not less than 0.05% and not more than 0.3% of Si. More preferred contents are not less than 0.05% and not more than 0.4% of Mg, particularly not less than 0.1% and not more than 0.4% of Mg, not less than 0.005% and not more than 0.15% in total of Mn, Ni, Zr, Zn, Cr, and Ag, not less than 0.05% and not more than 0.4% of Cu, and not less than 0.05% and not more than 0.2% of Si. While a content of Mg exceeding 0.5%, a total content of Mn, Ni, Zr, Zn, Cr, and Ag exceeding 0.2%, and a content of Cu exceeding 0.5% allow the Al alloy to have a higher strength, they also reduce the electrical conductivity and the toughness and cause wire breakage to be more likely to occur during wiredrawing for example. A content of Si exceeding 0.3% causes reduction in electrical conductivity and toughness.

Regarding the Al alloy to constitute the Al alloy wire of the present invention, examples of the specific composition of the Al alloy containing the above-described additive elements in addition to Fe may include (1) to (4) as follows.

(1) A composition including not less than 0.90% and not more than 1.20% by mass of Fe, not less than 0.10% and not more than 0.25% by mass of Mg, and a remainder including Al and an impurity.

(2) A composition including not less than 1.01% and not more than 2.2% by mass of Fe, not less than 0.05% and not more than 0.5% by mass of Mg, not less than 0.005% and not more than 0.2% by mass in total of at least one element selected from Mn, Ni, Zr, Zn, Cr, and Ag, and a remainder including Al and an impurity.

(3) A composition including not less than 1.01% and not more than 2.2% by mass of Fe, not less than 0.05% and not more than 0.5% by mass of Cu, and a remainder including Al and an impurity.

(4) A composition including not less than 1.01% and not more than 2.2% by mass of Fe, not less than 0.05% and not more than 0.5% by mass of Cu, at least one of not less than 0.1% and not more than 0.5% by mass of Mg and not less than 0.05% and not more than 0.3% by mass of Si, and a remainder including Al and an impurity.

Further, the above-described Al alloy containing at least one of Ti and B can further be improved in strength. Ti and B have the effect of refining the crystal structure of the Al alloy at the time of casting. The fine crystal structure can improve the strength. While it may be only B that is contained, containing of only Ti or particularly containing of both B and Ti enhances the effect of refining the crystal structure. In order to have a sufficient effect of refining the crystal structure, it is preferable that not less than 100 ppm and not more than 500 ppm (not less than 0.01% and not more than 0.05%) by mass ratio of Ti and not less than 10 ppm and not more than 50 ppm (not less than 0.001% and not more than 0.005%) by mass ratio of B are contained. A Ti content higher than 500 ppm and a B content higher than 50 ppm saturate the above-described refinement effect or cause the electrical conductivity to decrease.

<<Characteristics>>

The Al alloy wire of the present invention is formed of the Al alloy of the present invention having a specific composition and is a softened material, and therefore, the Al alloy wire is excellent in electrical conductivity and toughness and has an electrical conductivity of not less than 58% IACS and an elongation of not less than 10%. The Al alloy wire of the present invention can also satisfy an electrical conductivity of not less than 59% IACS and an elongation of not less than 25%, which however may be influenced by the type and the quantity of additive element(s) and the softening condition.

The inventors of the present invention have also conducted studies to make a finding that, depending on the softening condition (method), the electrical conductivity and the toughness can be increased and the corrosion resistance can be improved. Specifically, when the softening treatment is performed in the form of batch treatment (bright treatment) as described later herein, the electrical conductivity and the elongation tend to be increased and, when the softening treatment is performed in the form of continuous treatment as described later herein, the corrosion resistance tends to be enhanced. Al alloy wires undergoing these softening treatments respectively have been examined. These Al alloy wires are different in how precipitates are present. In the case where the continuous softening treatment is performed, the number of very fine precipitates of not more than 100 nm is smaller. In the case where the batch softening treatment is performed, the number of the precipitates is larger as compared with the continuous softening treatment. Specifically, the obtained Al alloy wires are as follows.

Continuous Softening Treatment: In an Al alloy wire to be used as a conductor that contains not less than 0.005% and not more than 2.2% by mass of Fe and a remainder including Al and an impurity, an observation field of 2400 nm×2600 nm is taken from a cross section of this Al alloy wire. The number of precipitates that are present in this observation field and have a circle-equivalent diameter of 100 nm or less is 10 or less.

Batch Softening Treatment: In an Al alloy wire to be used as a conductor that contains not less than 0.005% and not more than 2.2% by mass of Fe and a remainder including Al and an impurity, an observation field of 2400 nm×2600 nm is taken from a cross section of this Al alloy wire. The number of precipitates that are present in this observation field and have a circle-equivalent diameter of 100 nm or less is more than 10.

In addition to Fe, the above-described additive elements (Mg, Si, Cu, Zn, Ni, Mn, Ag, Cr, Zr) in the above-described range may be contained, and Ti and/or B may further be contained.

The reason why the difference is caused in how precipitates are present is considered as follows. In the case of the continuous softening treatment, a workpiece being subjected to the softening treatment is likely to have a high temperature. Accordingly, Fe having been precipitated in the casting process or in the rolling process after the casting process for example may be re-mixed in the solid state, and/or a high rate of temperature decrease (cooling rate) after the softening treatment, namely a high likelihood of rapid cooling is less likely to cause precipitation of Fe mixed in the solid state. In the case of the batch softening treatment as compared with the continuous softening treatment, a workpiece being subjected to the softening treatment is less likely to have a high temperature. Accordingly, re-mixture of the solid-state Fe is less likely to occur and/or a slow cooling (lower rate of temperature decrease) after the softening treatment is more likely to cause precipitation of Fe than the continuous softening treatment.

Crystal precipitates are generated mainly in the casting process. After the wiredrawing, the continuous softening treatment is performed to reduce fine precipitates. Thus, the continuous softening treatment can provide an Al alloy wire having an excellent strength because Fe in the solid state is sufficiently mixed in a base material, and also having an excellent corrosion resistance. In contrast, while the batch softening treatment generates more fine precipitates than the continuous softening treatment, the precipitates each have a size of 100 nm or less and the number of the present precipitates is at most 100 precipitates/above-described observation field. The fine precipitates can be changed in size and number by adjusting the softening condition. For example, the heating temperature for the softening treatment and the rate of temperature decrease (cooling rate) can be increased to reduce the precipitate's size and the amount of present precipitates. Therefore, depending on the condition of the batch softening treatment, an Al alloy wire can be obtained in which the precipitate's size is 80 nm or less, or further 50 nm or less, and the number of present precipitates is 50 or less, or further 20 or less, for example. Even when the batch softening treatment is performed, Fe mixed in the solid state in the base material provides a high strength to the Al alloy wire, and the structure in which the above-described fine precipitates are uniformly dispersed provides a high toughness to the Al alloy wire. Moreover, a smaller amount of solid-state-mixed Fe as compared with the continuous softening treatment can provide a high electrical conductivity to the Al alloy wire.

The Al alloy wire of the present invention preferably has a tensile strength of not less than 110 MPa and not more than 200 MPa. The inventors of the present invention have made a finding that a conductor for an electric wire that merely has a high strength and is inadequate in terms of the toughness is not suitable for a wire harness. Generally, improvement of the strength causes reduction of the toughness. The tensile strength satisfying the above-described range can provide a high toughness and a high strength at the same time. Further, the Al alloy wire of the present invention preferably has a 0.2% proof stress of not less than 40 MPa. In the case of wires of the same tensile strength, a wire with a higher 0.2% proof stress tends to have a higher securing strength with a terminal portion.

Additive element(s) (type and content) and manufacturing conditions (such as softening condition) can be adjusted appropriately to produce an Al alloy wire having its electrical conductivity, elongation, tensile strength, and 0.2% proof stress that satisfy their respective specific ranges defined above. When additive element(s) is (are) reduced or the heating temperature for the softening treatment is raised and thereafter the rate at which the temperature is lowered is decreased, the electrical conductivity and the toughness tend to increase. When the additive element(s) is (are) increased or the heating temperature for the softening treatment is lowered, the strength and the 0.2% proof stress tend to increase. For example, the tensile strength may be set to 120 MPa or more.

<<Shape>>

For the Al alloy wire of the present invention, the extent to which the wire is drawn (rate of decrease in cross section) can appropriately be adjusted to allow the wire to have any of various wire diameters (diameters). For example, when the Al alloy wire is used as a conductor for an electric wire of a motor vehicle's wire harness, the wire diameter is preferably not less than 0.2 mm and not more than 1.5 mm.

The Al alloy wire of the present invention can also have any of various cross-sectional shapes depending on the die shape used for wiredrawing. The cross-sectional shape is typically a circular shape. In addition, the cross-sectional shape may also be an elliptical shape, a polygonal shape such as rectangular shape and hexagonal shape, and the like. The cross-sectional shape is not limited to a particular one.

[Al Alloy Stranded Wire]

The above-described Al alloy wire of the present invention may be a stranded wire made up of a plurality of wires stranded together. Even if the wires are of a small diameter, they may be stranded together to constitute a wire (stranded wire) with a high strength. The number of wires to be stranded together is not limited to a particular one. Examples of the number of wires may be 7, 11, 19, and 37. Further, the Al alloy stranded wire of the present invention may be a compressed wire in which the wires are stranded together and thereafter compression-molded, so that the wire diameter is smaller than the stranded wire in which the wires are only stranded together.

[Covered Electric Wire]

The Al alloy wire of the present invention, the Al alloy stranded wire and the compressed wire of the present invention as described above can suitably be used as a conductor for an electric wire. Depending on the intended use, they may each be used as it is as a conductor, or as a covered electric wire including an insulating cover layer formed of an insulating material around the outer periphery of the conductor. The insulating material can be selected as appropriate. Examples of the insulating material may include polyvinyl chloride (PVC), non-halogen resin, a material excellent in flame resistance, and the like. The thickness of the insulating cover layer may be appropriately selected in consideration of a desired insulating strength, and is not particularly limited.

[Wire Harness]

The above-described covered electric wire can suitably be used for a wire harness. At this time, at an end of the covered electric wire, a terminal portion is attached so that the wire can be connected to an intended object such as device. The terminal portion may be in any of various forms such as male type, female type, crimp type, and weld type, and is not particularly limited. The above-described wire harness may also include a group of electric wires where a plurality of covered electric wires share a single terminal. Further, a plurality of covered electric wires included in this wire harness may be bound together by a binding tool or the like so that an excellent handling property is achieved. This wire harness can suitably be used in various fields in which lightweight is desired, particularly in a motor vehicle for which further reduced weight is desired for the purpose of improving fuel economy.

[Manufacturing Method]

<<Casting Step>>

In accordance with a manufacturing method of the present invention, a cast material made of an Al alloy having the specific composition as described above is formed first. Casting to be used may be any of continuous casting for which a movable mold or a frame-shaped fixed mold is used, and mold casting for which a box-shaped fixed mold is used (hereinafter referred to as billet casting). The continuous casting can rapidly solidify a molten metal and therefore provide a cast material having a fine crystal structure. Further, the rapid solidification can refine crystal precipitates, and accordingly provide the cast material in which the fine crystal precipitates are uniformly dispersed. Use of such a cast material as a base material facilitates manufacture of an Al alloy wire having a fine crystal structure, and can improve the strength by refinement of the crystal, and improve the toughness by the dispersion of fine crystal precipitates. While the rate of cooling may be selected as appropriate, the cooling rate is preferably 1° C./sec or more and is more preferably 4° C./sec or more. More preferably, the cooling rate is 20° C./sec or more within a range of 600 to 700° C. that is a temperature range in which the solid and the liquid of the molten metal coexist. For example, a continuous casting machine having a water-cooled copper mold and/or a forced water-cooling mechanism and the like may be used to achieve the rapid solidification at the cooling rate as described above. For the continuous casting, the cooling rate can be adjusted to provide rapid solidification and thereby reduce the DAS (Dendrite Arm Spacing) of the cast material obtained after the casting. DAS is preferably not more than 50 μm and is more preferably not more than 40 μm.

In the case where Ti and/or B are/is to be added, it may preferably be added immediately before a molten metal is poured into a mold, so that local setting of Ti for example can be suppressed to thereby manufacture a cast material in which Ti for example is uniformly mixed.

<<Rolling Step>>

Next, the above-described cast material undergoes (hot) rolling to form a rolled material. Particularly in the case where a billet cast material is used, preferably the material after being cast may undergo a homogenization treatment.

The above-described casting step and rolling step may be performed successively to facilitate hot rolling by using the heat accumulated in the cast material, achieve high energy efficiency, and provide excellent productivity of the cast and rolled material as compared with the batch-type casting method.

<<Wiredrawing Step>>

Next, the above-described rolled material or continuously cast and rolled material undergoes (cold) wiredrawing to form a wiredrawn material. The extent to which the material is wiredrawn may be selected as appropriate depending on a desired wire diameter. A desired number of wiredrawn materials thus obtained may be prepared and stranded together to form a stranded wire.

<<Softening Treatment (Final Heat Treatment) Step>>

Next, the above-described wiredrawn material or stranded wire undergoes softening treatment. The softening treatment is performed under the condition that allows the elongation of the wire (single wire or stranded wire) after being softening-treated to be 10% or more. The softening treatment may be performed after wiredrawing and after stranding to allow the final stranded wire's elongation to be 10% or more. The softening treatment is performed to soften the wire and improve the toughness of the wire without excessively reducing the strength of the wire that has been enhanced by refinement of the crystal structure and work hardening.

For the softening treatment, continuous treatment or batch treatment may be used. As to the atmosphere during the softening treatment, in order to suppress generation of an oxide film on the surface of the wire due to heat during the treatment, the atmosphere is preferably air or an atmosphere with a lower oxygen content (such as non-oxidizing atmosphere for example). Examples of the non-oxidizing atmosphere may include vacuum atmosphere (reduced-pressure atmosphere), inert gas atmosphere such as nitrogen ($N_2$) or argon (Ar), and reducing gas atmosphere such as hydrogen-contained gas (hydrogen ($H_2$) only, gas mixture of an inert gas such as $N_2$, Ar or helium (He) and hydrogen ($H_2$), for example), and carbonic-acid-gas-contained gas (gas mixture of carbon monoxide (CO) and carbon dioxide ($CO_2$), for example).

<Batch Treatment>

The batch treatment (bright softening treatment) refers to a treatment method of heating a workpiece to be heated that is enclosed in a heating vessel (atmosphere furnace, such as box-shaped furnace for example). While the throughput per treatment is limited, the treatment method can easily manage the heating state of the whole workpiece. The batch treatment can set the heating temperature to 250° C. or more to allow the elongation of the wire to be 10% or more. Preferred conditions are that the heating temperature is not less than 300° C. and not more than 500° C., and the holding time is not less than 0.5 hour and not more than 6 hours. Where the heating temperature is lower than 250° C., the toughness and the electrical conductivity are difficult to be improved. Where the heating temperature is higher than 500° C. or the holding time is longer than 6 hours, the strength decreases. Further, in the batch treatment, the rate of lowering the heating temperature, namely the rate of temperature decrease after heating is preferably 50° C./sec or less. The temperature decrease rate can be set relatively low to perform slow cooling and thereby cause a relatively large amount of fine precipitates. The above-described temperature decrease rate can be satisfied by continuously keeping in the furnace the workpiece after being heated, rather than removing the workpiece from the furnace immediately after heating the workpiece.

<Continuous Treatment>

The continuous treatment refers to a treatment method of continuously supplying a workpiece to be heated into a heating vessel and continuously heating the workpiece, and has advantages including: 1. the wire can be heated continuously and therefore workability is excellent; and 2. the wire can be heated uniformly in the longitudinal direction and therefore variation in characteristics in the longitudinal direction of the wire can be suppressed. In particular, in the case where a long wire such as the one used as a conductor for an electric wire undergoes the softening treatment, the continuous treatment can suitably be used. Examples of the continuous treatment may include a direct energizing heating method heating a workpiece to be heated by resistance heating (continuous softening treatment by means of electric power), an indirect energizing heating method heating a workpiece to be heated by electromagnetic induction of high frequencies (continuous softening treatment by high-frequency induction heating), and a furnace method feeding a workpiece to be heated into a heating vessel (pipe softening furnace) with a heating atmosphere and heating the workpiece by heat transfer. A wire with an elongation of 10% or more is obtained by the continuous treatment in the following manner for example. A sample is subjected to softening treatment in which a control parameter that may be responsible for a desired characteristic (elongation here) is varied as appropriate, the characteristic (elongation) of the sample at this time is measured, and correlation data between the value of the parameter and the measured data is prepared. Based on the correlation data, the parameter is adjusted so that a desired characteristic (elongation) may be obtained. The control parameter for the method by means of electric power may include the rate at which the workpiece is fed into the vessel (wire rate), the size of the workpiece to be heated (wire diameter), and the electric current value, for example. The control parameter for the furnace method may include the rate at which the workpiece is fed into the vessel (wire rate), the size of the workpiece to be heated (wire diameter), and the size of the furnace (diameter of the pipe softening furnace), for example. In the case where a softening apparatus is placed on the side of the wiredrawing machine from which a wiredrawn material is discharged, the wire rate may be set to several hundreds of m/min or more, for example, 400 m/min or more to thereby obtain a wire with an elongation of 10% or more. Further, for the continuous treatment, preferably the temperature decrease rate after the heating process is 50° C. or more. A relatively low temperature decrease rate can suppress generation of fine precipitates and make the amount of the precipitates relatively small. The temperature decrease rate can be adjusted by adjustment of the wire rate for example as described above.

<<Other Steps>>

The manufacturing method of the present invention may further include the step of forming a stranded wire by stranding together a plurality of the above-described wiredrawn materials or softened materials, and the step of forming a compressed wire with a predetermined wire diameter by compression-molding this stranded wire to thereby manufacture a compressed wire. In the case of the stranded wire form, the softening treatment may be performed only on the wiredrawn material before being stranded, or before and after the wires are stranded, or the softening treatment may not be performed on the drawn wire before being stranded and may be performed only on the stranded wire or compressed wire. In the case where a softened material having a predetermined elongation is produced before the material is stranded and a compressed wire is formed by using this softened material or a compressed wire is formed by using a stranded wire (softened material) having been stranded to have a certain elongation, the softening treatment may not be performed after compression. The above-described insulating cover layer can be formed on the resultant compressed wire to produce a covered electric wire. A terminal portion may be attached to an end of the resultant covered dielectric wire, and a plurality of covered electric wires with terminal portions may be bound together to produce a wire harness.

Effects of the Invention

The Al alloy wire of the present invention, the Al alloy stranded wire of the present invention, the covered electric wire of the present invention, and the Al alloy of the present invention have a high strength and a high toughness as well as a high electrical conductivity. Further, the wire harness of the present invention has well-balanced strength, toughness, and electrical conductivity and is lightweight. The manufacturing method of the present invention can produce the above-described Al alloy wire of the present invention with high productivity.

MODES FOR CARRYING OUT THE INVENTION

Figure 1:
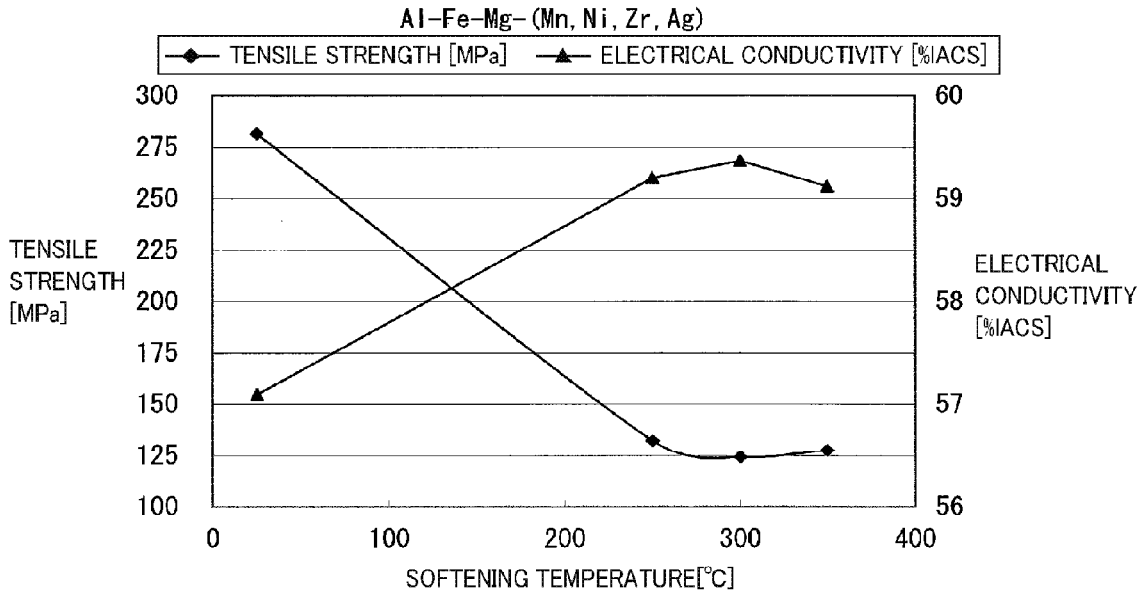
FIG. 1 is a graph showing a relationship of a temperature for softening treatment with an electrical conductivity and a tensile strength, for an Al—Fe—Mg—(Mn, Ni, Zr, Ag)-based alloy wire.

An Al alloy wire is produced, and this Al alloy wire is used to further produce a covered electric wire. Various characteristics of the Al alloy wire and the covered electric wire have been examined. The covered electric wire is produced through a procedure in the order of casting, rolling, wiredrawing, stranded wire, compression, softening, formation of an insulating cover layer.

[Characteristics of Al Alloy Wire]

First, an Al alloy wire is produced. As a base, pure aluminum (not less than 99.7% by mass of Al) is prepared and melt. To the obtained molten metal (molten aluminum), the additive elements shown in Table 1 with respective contents shown in Table 1 are added to produce a molten Al alloy. On the molten Al alloy with adjusted components, a hydrogen gas removal treatment and/or a foreign-matter removal treatment are/is preferably performed as appropriate.

A belt-wheel-type continuous casting and rolling machine is used to continuously perform casting and hot rolling on the prepared molten Al alloy to produce a wire rod of ϕ9.5 mm (continuously cast and rolled material). For the above-described continuous casting, a cooling mechanism or the like is adjusted to set the cooling rate to 4.5° C./sec. The DAS of the resultant cast material has been measured by means of a structure photograph and the measured DAS is approximately 20 μm. Alternatively, the above-described molten Al alloy is poured into a predetermined fixed mold and cooled to produce a billet cast material, on which a homogenization treatment is performed and thereafter hot rolling is performed to produce a wire rod of ϕ9.5 mm (rolled material). For samples containing Ti or containing Ti and B, Ti particle or $TiB_2$ wire is fed to the molten Al alloy immediately before being cast so that the content(s) as shown in Table 1 is (are) satisfied.

The above-described wire rod is subjected to cold wiredrawing to produce a wiredrawn material with a wire diameter of ϕ0.3 mm. The wiredrawn material thus obtained is subjected to a softening treatment as shown in Table 1 to produce a softened material (Al alloy wire). For the softening treatment, a box-shaped furnace is used, and a batch treatment is performed in the atmosphere and at the heating temperature shown in Table 1 (holding time of each softening treatment is 3 hours, temperature decrease rate: 0.02° C./sec), or a continuous treatment is performed by means of a high-frequency induction heating method in the atmosphere shown in Table 1 (wire rate: 500 m/min, current value: 200 A, temperature decrease rate: 500° C./sec). Here, the continuous treatment has been performed on Samples No. 1-2 and No. 1-3, and the batch treatment has been performed on those samples other than samples No. 1-2 and No. 1-3 and having been softening-treated. The temperature in the continuous treatment has been measured with a non-contact infrared thermometer. For comparison's sake, untreated materials (Samples Nos. 1-102, 1-112) that are not softening-treated after being wiredrawn have also been prepared.

TABLE 1

(Al—Fe—Mg)

| Softened Material | Additive Elements (mass %) | | | | Conditions of Manufacture | | |
|---|---|---|---|---|---|---|---|
| | | | | | | Softening Temperature | Softening Treatment |
| Sample No. | Fe | Mg | Ti | B | Casting | (° C.) | Atmosphere |
| 1-1 | 1.05 | 0.15 | 0.03 | 0.005 | continuous casting | 350 | nitrogen gas |
| 1-2 | 1.05 | 0.15 | 0.03 | 0.005 | continuous casting | 500 | air |
| 1-3 | 1.05 | 0.15 | 0.03 | 0.005 | billet casting | | |
| 1-4 | 1.05 | 0.15 | 0.03 | 0.005 | billet casting | 350 | nitrogen gas |

(Al—Fe—Mg—(Mn,Ni,Zr,Ag))

| Softened Material Sample | Additive Elements (mass %) | | | | | | | | Conditions of Manufacture | | |
|---|---|---|---|---|---|---|---|---|---|---|---|
| | | | | | | | | | | Softening Temperature | Softening Treatment |
| No. | Fe | Mg | Mn | Ni | Zr | Ag | Ti | B | Casting | (° C.) | Atmosphere |
| 1-11 | 1.05 | 0.2 | 0.05 | — | — | — | 0.02 | 0.005 | continuous casting | 350 | reducing gas |
| 1-12 | 1.05 | 0.2 | — | 0.05 | — | — | — | — | continuous casting | 350 | reducing gas |
| 1-13 | 1.05 | 0.2 | — | — | 0.05 | — | 0.02 | 0.005 | continuous casting | 350 | nitrogen gas |
| 1-14 | 1.05 | 0.2 | — | — | — | 0.1 | 0.02 | — | continuous casting | 350 | reducing gas |
| 1-15 | 1.05 | 0.2 | 0.05 | — | — | — | — | 0.005 | billet casting | 350 | reducing gas |
| 1-16 | 0.8 | 0.05 | 0.05 | — | — | — | — | — | continuous casting | 350 | reducing gas |
| 1-101 | 3 | 0.8 | — | — | 3 | — | — | — | continuous casting | 350 | reducing gas |
| 1-102 | 1.05 | 0.2 | 0.05 | — | — | — | 0.02 | 0.005 | continuous casting | — | — |

TABLE 1-continued

| (Al—Fe—Cu) | | | | | | | | | |
|---|---|---|---|---|---|---|---|---|---|
| Softened Material Sample | Additive Elements (mass %) | | | | | | Conditions of Manufacture | | |
| | | | | | | | | Softening Temperature | Softening Treatment |
| No. | Fe | Cu | Mg | Si | Ti | B | Casting | (° C.) | Atmosphere |
| 1-21 | 1.05 | 0.2 | — | — | — | — | continuous casting | 350 | argon gas |
| 1-22 | 1.05 | 0.3 | 0.2 | — | 0.02 | 0.005 | continuous casting | 350 | reducing gas |
| 1-23 | 1.1 | 0.2 | — | 0.1 | 0.02 | 0.005 | continuous casting | 350 | nitrogen gas |
| 1-24 | 1.1 | 0.2 | 0.2 | 0.1 | 0.02 | — | continuous casting | 350 | reducing gas |
| 1-25 | 1.05 | 0.2 | — | — | — | — | billet casting | 350 | reducing gas |
| 1-26 | 0.8 | 0.02 | — | — | — | — | continuous casting | 350 | reducing gas |
| 1-111 | 3 | 0.8 | — | — | — | — | continuous casting | 350 | reducing gas |
| 1-112 | 1.05 | 0.2 | 0.2 | — | 0.02 | 0.005 | continuous casting | — | — |

For the obtained softened materials with a wire diameter of 0.3 mm and the untreated materials, the tensile strength (MPa), the elongation (%), the 0.2% proof stress (MPa), and the electrical conductivity (% IACS) have been measured. The results are shown in Table 2.

The tensile strength (MPa) and the elongation (%, fracture elongation), and the 0.2% proof stress (MPa) have been measured in compliance with JIS Z 2241 (method of tensile test for metallic materials, 1998) by means of a general-purpose tensile tester. The electrical conductivity (% IACS) has been measured by the bridge method.

TABLE 2

| Softened Material Sample No. | Material Characteristics | | | |
|---|---|---|---|---|
| | Tensile Strength (MPa) | Elongation (%) | 0.2% Proof Stress (MPa) | Conductivity (% IACS) |
| (Al—Fe—Mg) | | | | |
| 1-1 | 115 | 25 | 62 | 60 |
| 1-2 | 115 | 21 | 62 | 58 |
| 1-3 | 115 | 15 | 62 | 58 |
| 1-4 | 115 | 15 | 62 | 60 |
| (Al—Fe—Mg—(Mn,Ni,Zr,Ag)) | | | | |
| 1-11 | 128 | 26 | 63 | 58 |
| 1-12 | 128 | 25 | 62 | 59 |
| 1-13 | 129 | 27 | 62 | 58 |
| 1-14 | 129 | 27 | 61 | 59 |
| 1-15 | 128 | 14 | 59 | 58 |
| 1-16 | 115 | 20 | 55 | 59 |
| 1-101 | 170 | 7 | 92 | 40 |
| 1-102 | 231 | 2 | 115 | 56 |
| (Al—Fe—Cu) | | | | |
| 1-21 | 123 | 30 | 58 | 61 |
| 1-22 | 143 | 19 | 57 | 58 |
| 1-23 | 126 | 28 | 59 | 60 |
| 1-24 | 147 | 15 | 60 | 58 |
| 1-25 | 123 | 18 | 56 | 61 |
| 1-26 | 118 | 29 | 52 | 61 |
| 1-111 | 146 | 8 | 75 | 55 |
| 1-112 | 252 | 2 | 116 | 56 |

As shown in Table 1, Samples Nos. 1-1 to 1-4, 1-11 to 1-16, and 1-21 to 1-26 each made of an Al—Fe-based alloy having a specific composition and having undergone the softening treatment have an electrical conductivity of not less than 58% IACS, an elongation of not less than 10%, and further have a 0.2% proof stress of not less than 40 MPa and a tensile strength of not less than 110 MPa. Namely, Samples Nos. 1-1 to 1-4, 1-11 to 1-16, and 1-21 to 1-26 each have not only a high electrical conductivity and a high toughness but also a high strength. In particular, containing, in addition to Fe, of at least one additive element selected from Mg, Si, Cu, Zn, Ni, Mn, Ag, Cr, and Zr is likely to make the strength higher. A still higher strength is achieved by containing, in addition to Mg, of Mn, Ni, Zr, Ag, or containing, in addition to Cu, of Mg or Si or Mg and Si both. From a comparison between samples of the same composition, it is seen that a sample on which continuous casting and rolling has been performed tends to have a larger elongation than a sample on which billet casting has been performed. Depending on the composition, the elongation is 25% or more which means that the toughness is excellent.

In contrast, Samples No. 1-102 and No. 1-112 which have not been softening-treated has a high strength while their elongation is very smaller resulting in lower toughness and their electrical conductivity is lower. As to a sample which has been softening-treated while it does not have a specific composition, specifically Samples No. 1-101 and 1-111 with higher contents of Fe and other additive elements have a high strength while their elongation and electrical conductivity are lower.

[Softening Treatment Condition (Temperature) and Characteristics]

Figure 2:
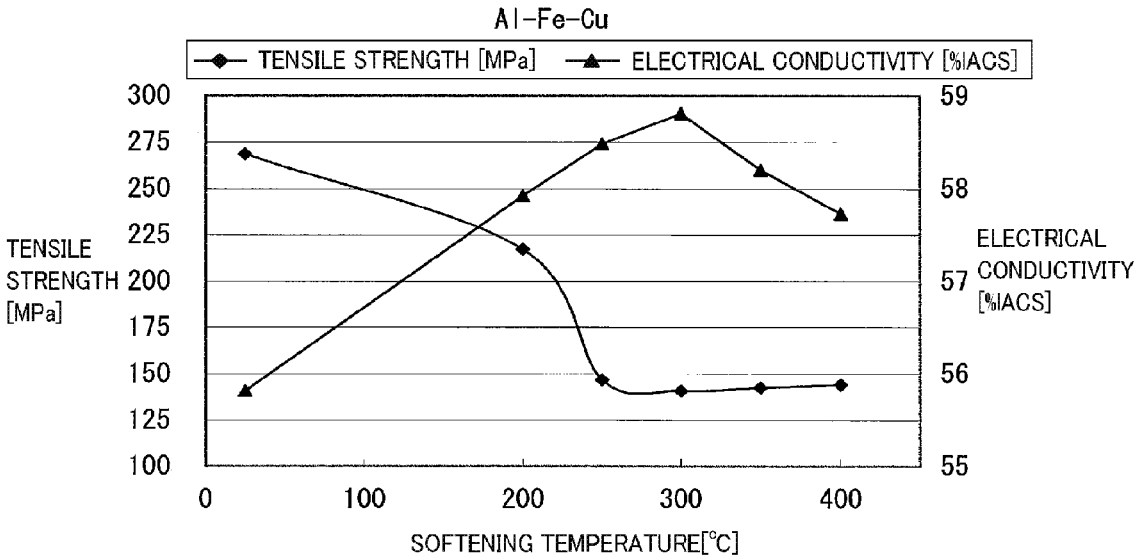
FIG. 2 is a graph showing a relationship of a temperature for softening treatment with an electrical conductivity and a tensile strength, for an Al—Fe—Cu-based alloy wire.

Samples softening-treated under different conditions have been produced and the electrical conductivity (%) and the tensile strength (MPa) of the resultant samples have been examined. The results are shown in FIGS. 1 and 2. Here, the softening treatment has been performed on wiredrawn materials with the compositions of Sample No. 1-12 (FIG. 1) and Sample No. 1-22 (FIG. 2) and a wire diameter of ϕ0.3 mm. The softening treatment has been performed on the withdrawn materials as a batch treatment using a box-shaped furnace (reducing gas atmosphere, temperature decrease rate: 0.02° C./sec) and a heating temperature (softening temperature) selected as appropriate from a range of 200 to 400° C. (holding time: 3 hours).

As seen from FIGS. 1 and 2, the softening treatment can be performed at a heating temperature of 250° C. or more to obtain a softened material having an electrical conductivity of not less than 58% IACS and a tensile strength of not less than 120 MPa. The temperature of 200° C. appears to cause the tensile strength to be too high, resulting in a smaller elongation and a lower toughness.

[Structure of Softened Material]

Figure 3:
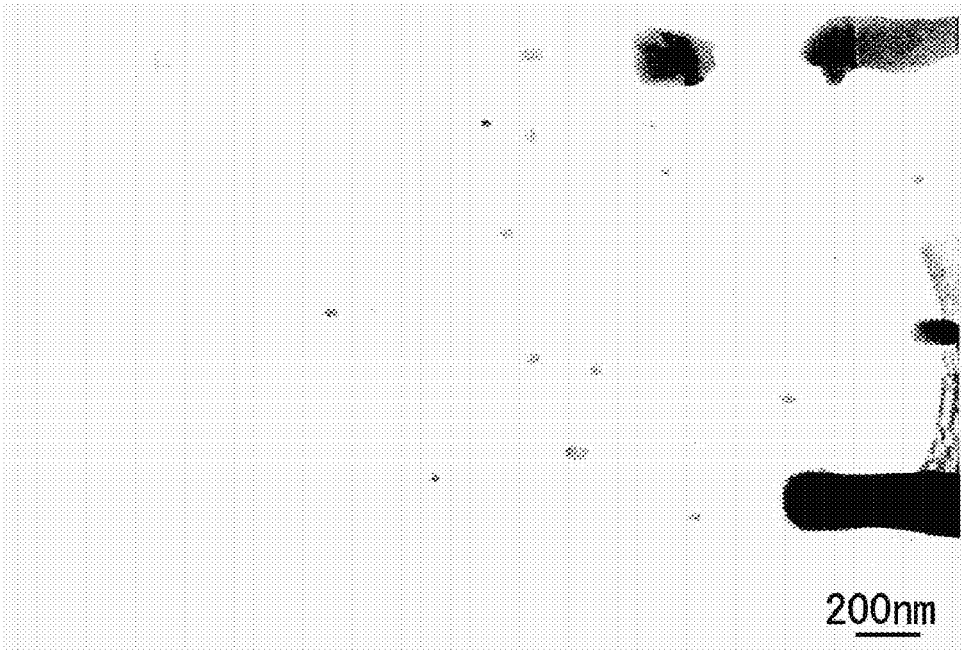
FIG. 3 is a microscope photograph of a cross section of an Al alloy wire, FIG. 3 (1) shows a sample having undergone a batch softening treatment, and FIG. 3 (2) shows a sample having undergone a continuous softening treatment.
Figure 3:
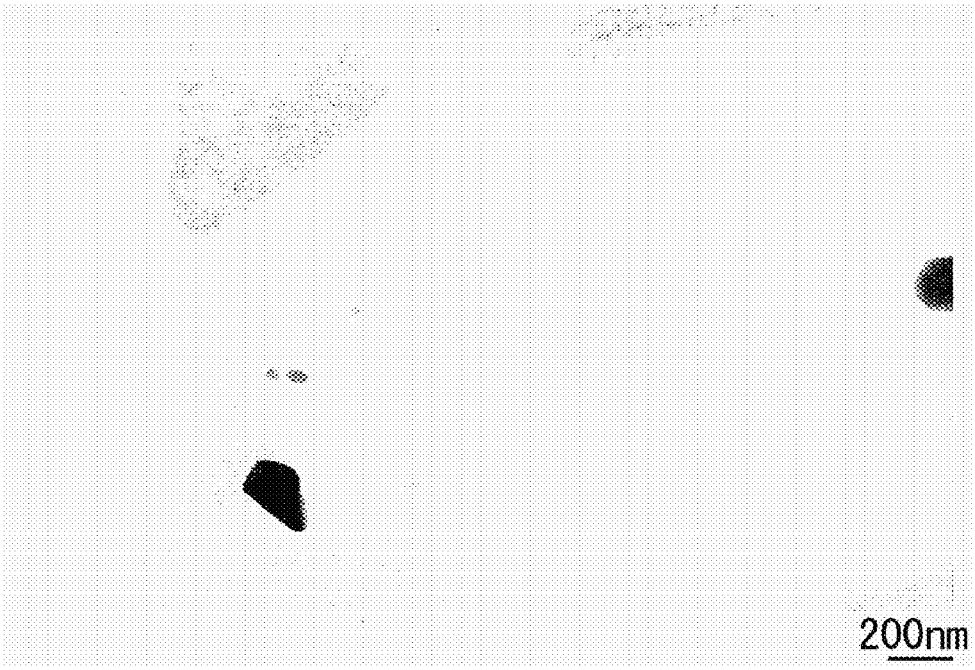

FIG. 3 is a transmission electron microscope (TEM) photograph (×45000) of a cross section of a produced softened material. Sample No. 1-1 (batch softening treatment) is shown in FIG. 3 (1), and Sample No. 1-2 (continuous softening treatment) is shown in FIG. 3 (2). In FIG. 3, the small dark gray dots represent precipitates, and the relatively larger black dots (dots having a circle-equivalent diameter exceeding 200 nm) are crystallizations. As shown in FIG. 3 (2), it is seen that the sample having undergone the continuous softening treatment includes less fine precipitates with a circle-equivalent diameter of 100 nm or less. As shown in FIG. 3 (1), it is also seen that the sample having undergone the batch softening treatment includes more fine precipitates with a circle-equivalent diameter of 100 nm or less than the sample having undergone the continuous softening treatment. Three observation fields of 2400 nm×2600 nm have been taken from one cross section, and the number of precipitates that are present in each observation field and have a circle-equivalent diameter of 100 nm or less has been measured. It has been found that, in the sample having undergone the continuous softening treatment, the number of precipitates of 100 nm or less in the above-described observation field (average of the three observation fields) is 3 (less than 10) and, in the sample having undergone the batch softening treatment, the number is 18 (more than 10 and not more than 20). The size of a precipitate (circle-equivalent diameter) is the diameter of a circle into which the area of the precipitate is converted in an image-processed microscope photograph.

[Characteristics of Covered Electric Wire]

It is expected that an Al alloy wire made of an Al—Fe-based alloy having a specific composition and softening-treated as described above can suitably be used as a conductor for an electric wire of a wire harness. Thus, a covered electric wire has been produced to examine its mechanical characteristics.

A plurality of wiredrawn materials (see Table 1 for the composition) with a wire diameter of ϕ0.3 mm produced in the above-described manner are stranded together to produce a stranded wire. Here, 11 drawn wires in total consisting of three inner wires and eight outer wires are stranded together and thereafter subjected to compression working so that the profile of the cross section is circular so as to produce a compressed wire of 0.75 $mm^2$. On the resultant compressed wire, a softening treatment (batch treatment by means of a box-shaped furnace, or continuous treatment by means of high-frequency induction heating method) is performed in the atmosphere and at the heating temperature shown in Table 1 basically under similar conditions to those for the softening treatment performed on the wiredrawn material of ϕ0.3 mm as described above. On the outer periphery of the softened material thus obtained, an insulating material (here halogen-free insulating material) is used to form an insulating cover layer (0.2 mm in thickness) so as to produce a covered electric wire. For comparison's sake, untreated materials (Samples No. 2-102, No. 2-112) have also been prepared by stranding wiredrawn materials together and compressing the stranded wire into a compressed wire on which no softening treatment is performed.

For the covered electric wires thus obtained, the impact resistance (J/m) and the terminal securing strength (N) have been examined. The results are shown in Table 3.

Figure 4:
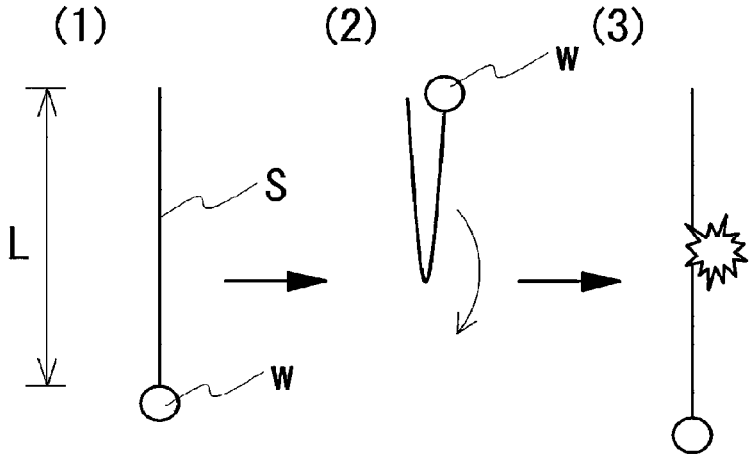
FIG. 4 is an illustration for illustrating a test method for an impact resistance test.

The impact resistance (J/m or (N·m)/m) has been evaluated in the following manner. FIG. 4 is an illustration for illustrating a test method for an impact resistance test. To an end of a sample S (point-to-point distance to be evaluated L: 1 m), a weight w is attached (FIG. 4 (1)), this weight w is raised by 1 m and thereafter let fall freely (FIG. 4 (2)). Then, a maximum weight (kg) of weight w that does not cause breakage of sample S is measured, the measured weight is multiplied by the gravitational acceleration (9.8 $m/s^2$) and the fall distance 1 m, the product is divided by the fall distance, and the resultant value thus determined is used as an impact resistance (J/m or (N·m)/m) for evaluation.

Figure 5:
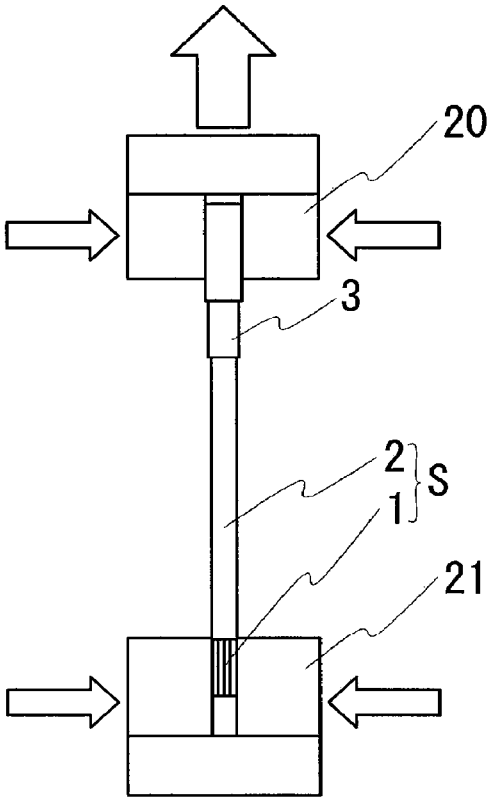
FIG. 5 is an illustration for illustrating a test method for a terminal-securing-strength test.

The terminal securing strength (N) has been evaluated in the following manner. FIG. 5 is an illustration for illustrating a test method for a terminal securing strength test. For a sample S formed of a stranded wire 1 around which an insulating cover layer 2 is provided, cover layer 2 is stripped at the two opposite ends to expose stranded wire 1. A terminal portion 3 is attached to one end of stranded wire 1 and this terminal portion 3 is held in a terminal chuck 20. The other end of stranded wire 1 is held in a wire chuck 21. A general-purpose tensile tester is used to measure the maximum load (N) at the time of fracture of sample S held at its two ends by chucks 20, 21, and the maximum load (N) is used as a terminal securing strength (N) for evaluation.

TABLE 3

| | | Electric Wire Performance | |
|---|---|---|---|
| Electric Wire Sample No. | Softened Material Sample No. | Impact Resistance (J/m) | Terminal Securing Strength (N) |
| (Al—Fe—Mg) | | | |
| 2-1 | 1-1 | 12 | 70 |
| 2-2 | 1-2 | 11 | 71 |
| 2-3 | 1-3 | 10 | 71 |
| 2-4 | 1-4 | 10 | 70 |
| (Al—Fe—Mg—(Mn,Ni,Zr,Ag)) | | | |
| 2-11 | 1-11 | 12 | 72 |
| 2-12 | 1-12 | 12 | 71 |
| 2-13 | 1-13 | 12 | 72 |
| 2-14 | 1-14 | 12 | 72 |
| 2-15 | 1-15 | 10 | 71 |
| 2-16 | 1-16 | 14 | 60 |
| 2-101 | 1-101 | 6 | 105 |
| 2-102 | 1-102 | 2 | 123 |
| (Al—Fe—Cu) | | | |
| 2-21 | 1-21 | 12 | 72 |
| 2-22 | 1-22 | 11 | 83 |
| 2-23 | 1-23 | 12 | 72 |
| 2-24 | 1-24 | 10 | 83 |
| 2-25 | 1-25 | 11 | 72 |
| 2-26 | 1-26 | 14 | 60 |
| 2-111 | 1-111 | 6 | 83 |
| 2-112 | 1-112 | 2 | 130 |

As shown in Table 3, it is seen that the covered electric wires of Samples Nos. 2-1 to 2-4, 2-11 to 2-16, and 2-21 to 2-26 for which a stranded wire made of an Al—Fe-based alloy with a specific composition and having undergone the softening treatment is used have an excellent impact resistance and a high connection strength between the wire and a terminal portion.

[Softening Treatment Condition (Method) and Characteristics]

As the softening treatment, the batch treatment is performed on an Al alloy wire and the continuous treatment is performed on an Al alloy wire. The corrosion resistance and the mechanical characteristics of thus obtained Al alloy wires have been examined.

The Al alloy wires are produced in a similar manner to the above-described Al alloy wire of ϕ0.3 mm. Specifically, to molten pure aluminum similar to the above-described one, the additive elements shown in Table 4 are added at respective contents shown in Table 4 to produce a molten Al alloy. A belt-wheel-type continuous casting and rolling machine is used to produce a wire rod of ϕ9.5 mm (cooling temperature for casting: 4.5° C./sec, DAS of cast material: about 20 μm). This wire rod undergoes a cold wiredrawing treatment to produce a wiredrawn material with a wire diameter of ϕ0.3 mm, which undergoes the softening treatment (batch treatment (bright softening treatment) or continuous treatment) under the conditions shown in Table 4 to produce a softened material of ϕ0.3 mm (single wire). The conditions for the batch treatment at this time are basically similar to those for Sample No. 1-1 or 1-11, and the conditions for the continuous treatment are similar to those for Sample No. 1-2. 11 wiredrawn materials with a wire diameter of ϕ0.3 mm thus obtained are stranded together to produce a compressed wire of 0.75 $mm^2$. On the obtained compressed wire, the softening treatment (batch treatment or continuous treatment) is performed under the conditions shown in Table 4 to obtain a softened material (compressed wire) of 0.75 $mm^2$. The conditions for the batch treatment at this time are basically similar to those for Sample No. 2-1 or 2-11, and the conditions for the continuous treatment are similar to those for Sample No. 2-2.

On a wiredrawn material with a wire diameter of ϕ1.0 mm obtained in the process for producing the wiredrawn material with a wire diameter of ϕ0.3 mm as described above, the softening treatment indicated in Table 4 is performed similarly to the softening treatment performed on the softened material of ϕ0.3 mm, so as to produce a softened material. This softened material is used as a sample to measure the pitting potential (V) and the protective potential (V). The results are shown in Table 5.

The pitting potential and the protective potential have been measured in the following manner. First, a sample is immersed in an aqueous solution of 5% by mass of NaOH (60° C.) for a predetermined time (one minute) to remove a passivation film. Next, the sample is immersed in an aqueous solution of 55% by mass of $HNO_3$ for a predetermined time (about 10 seconds), washed and neutralized, and thereafter washed with water. The washed sample is immersed in an electrolytic solution (aqueous solution of 5% by mass of NaCl) and, for a predetermined time, a certain voltage is applied to cause reduction (−1.5 V, 5 minutes). After this, the potential is swept to measure the pitting potential and the protective potential. The measurements are taken by forming a three-electrode electrochemical measurement cell. This cell includes a vessel into which an electrolytic solution is poured, a reference electrode (RE): Ag/AgCl, a counter electrode (CE): Pt, and a sample to be measured that are immersed in the electrolytic solution. Respective ends of the RE, CE and sample are connected to a commercially available potentiostat/galvanostat apparatus, and a certain potential is applied as described above to measure a change in electric current. Here, the pitting potential refers to the potential when the current having reached 100 μA/$cm^2$ continues increasing. Regarding the protective potential, when the current becomes 1 mA/$cm^2$, the potential is swept in the opposite direction (here the cathode direction). The potential at which the current becomes zero is the protective potential. A smaller absolute value of the pitting potential and a smaller absolute value of the protective potential provide less pitting, namely superior corrosion resistance.

TABLE 4

| Softened Material | Additive Elements (mass %) | | | | | | | | | | Softening Treatment | | |
|---|---|---|---|---|---|---|---|---|---|---|---|---|---|
| Sample No. | Fe | Mg | Mn | Ni | Zr | Ag | Cu | Si, Cr, Zn | Ti | B | Method | Temperature (° C.) | Atmosphere |
| 3-1 | 1.00 | — | — | — | — | — | — | — | 0.03 | 0.005 | continuous | 500 | air |
| 3-2 | 1.00 | — | — | — | — | — | — | — | 0.03 | 0.005 | bright | 300 | nitrogen gas |
| 3-3 | 1.00 | 0.2 | 0.05 | — | — | — | — | — | 0.03 | 0.005 | continuous | 500 | air |
| 3-4 | 1.00 | 0.2 | 0.05 | — | — | — | — | — | 0.03 | 0.005 | bright | 350 | nitrogen gas |
| 3-5 | 1.00 | 0.2 | — | 0.05 | — | — | — | — | 0.03 | 0.005 | continuous | 500 | air |
| 3-6 | 1.00 | 0.2 | — | 0.05 | — | — | — | — | 0.03 | 0.005 | bright | 350 | nitrogen gas |
| 3-7 | 1.00 | 0.2 | — | — | 0.05 | — | — | — | 0.03 | 0.005 | continuous | 500 | air |
| 3-8 | 1.00 | 0.2 | — | — | 0.05 | — | — | — | 0.03 | 0.005 | bright | 350 | nitrogen gas |
| 3-9 | 1.00 | 0.2 | — | — | — | 0.1 | — | — | 0.03 | 0.005 | continuous | 500 | air |
| 3-10 | 1.00 | 0.2 | — | — | — | 0.1 | — | — | 0.03 | 0.005 | bright | 350 | nitrogen gas |
| 3-11 | 1.00 | — | — | — | — | — | 0.2 | — | 0.03 | 0.005 | continuous | 500 | air |
| 3-12 | 1.00 | — | — | — | — | — | 0.2 | — | 0.03 | 0.005 | bright | 350 | nitrogen gas |
| 3-13 | 1.00 | 0.2 | — | — | — | — | 0.2 | Si: 0.05 | 0.03 | 0.005 | continuous | 500 | air |
| 3-14 | 1.00 | — | — | — | — | — | 0.2 | Si: 0.05 | 0.03 | 0.005 | bright | 350 | nitrogen gas |
| 3-101 | 0.001 | — | — | — | — | — | — | — | 0.02 | 0.005 | bright | 250 | reducing gas |
| 3-15 | 0.2 | — | — | — | — | — | — | — | 0.02 | 0.005 | bright | 250 | reducing gas |
| 3-16 | 0.6 | — | — | — | — | — | — | — | 0.02 | 0.005 | bright | 350 | reducing gas |
| 3-17 | 1.7 | — | — | — | — | — | — | — | 0.02 | 0.005 | bright | 350 | reducing gas |
| 3-18 | 1.05 | 0.2 | — | — | — | — | — | Cr: 0.05 | 0.02 | 0.005 | bright | 350 | reducing gas |
| 3-19 | 1.05 | — | — | — | — | — | 0.2 | Cr: 0.05 | 0.02 | 0.005 | bright | 350 | reducing gas |
| 3-20 | 1.05 | 0.2 | — | — | — | — | — | Zn: 0.05 | 0.02 | 0.005 | bright | 350 | reducing gas |
| 3-21 | 1.05 | — | — | — | — | — | 0.2 | Zn: 0.05 | 0.02 | 0.005 | bright | 350 | reducing gas |
| 3-22 | 1.05 | 0.2 | — | — | — | — | — | — | 0.02 | 0.005 | bright | 350 | reducing gas |

For the softened material thus obtained, the tensile strength (MPa), the 0.2% proof stress (MPa), the elongation (%, fracture elongation), the electrical conductivity (% IACS), the impact resistance (J/m), and the terminal securing strength (N) have been examined in a similar manner to the above-described one. The results are shown in Table 5.

TABLE 5

| | ϕ1.0 mm | | ϕ0.3 mm | | | | 0.75 mm$^2$ | |
|---|---|---|---|---|---|---|---|---|
| Softened Material Sample No. | Pitting Potential (V) | Protective Potential (V) | Tensile Strength (MPa) | 0.2% proof stress (MPa) | Conductivity (% IACS) | Elongation (%) | Impact Resistance (J/m) | Terminal Securing Strength (N) |
| 3-1 | −0.69 | −1.09 | 112 | 50 | 60 | 30 | 12 | 59 |
| 3-2 | −0.82 | −1.15 | 111 | 51 | 62 | 34 | 12 | 58 |
| 3-3 | −0.71 | −1.13 | 127 | 56 | 58 | 23 | 13 | 72 |
| 3-4 | −0.82 | −1.14 | 128 | 55 | 58 | 26 | 15 | 73 |
| 3-5 | −0.70 | −1.13 | 127 | 57 | 58 | 22 | 14 | 73 |
| 3-6 | −0.82 | −1.16 | 128 | 56 | 59 | 25 | 14 | 72 |
| 3-7 | −0.72 | −1.14 | 126 | 50 | 58 | 21 | 13 | 71 |
| 3-8 | −0.85 | −1.16 | 129 | 63 | 58 | 27 | 16 | 74 |
| 3-9 | −0.65 | −1.08 | 130 | 62 | 58 | 22 | 13 | 75 |
| 3-10 | −0.75 | −1.12 | 129 | 64 | 59 | 27 | 16 | 75 |
| 3-11 | −0.68 | −1.09 | 123 | 61 | 58 | 25 | 14 | 72 |
| 3-12 | −0.73 | −1.13 | 123 | 62 | 61 | 30 | 15 | 72 |
| 3-13 | −0.65 | −1.07 | 142 | 71 | 58 | 17 | 11 | 83 |
| 3-14 | −0.71 | −1.13 | 143 | 68 | 58 | 19 | 11 | 85 |
| 3-101 | −0.77 | −1 | 108 | 50 | 62 | 17 | 12 | 66 |
| 3-15 | −0.73 | −1.01 | 112 | 45 | 61 | 22 | 12 | 65 |
| 3-16 | −0.72 | −1.09 | 111 | 56 | 62 | 20 | 13 | 69 |
| 3-17 | −0.68 | −1.2 | 125 | 73 | 60 | 25 | 16 | 72 |
| 3-18 | −0.71 | −1.09 | 124 | 60 | 58 | 24 | 17 | 73 |
| 3-19 | −0.73 | −1.08 | 124 | 59 | 60 | 30 | 15 | 75 |
| 3-20 | −0.69 | −1.07 | 123 | 56 | 58 | 23 | 16 | 74 |
| 3-21 | −0.71 | −1.07 | 124 | 57 | 59 | 29 | 18 | 76 |
| 3-22 | −0.71 | −1.11 | 126 | 59 | 59 | 28 | 19 | 78 |

As shown in Table 5, the Al alloy wire made of an Al—Fe-based alloy having a specific composition and having undergone the softening treatment has an electrical conductivity of not less than 58% IACS, an elongation of not less than 10%, a 0.2% proof stress of not less than 40 MPa, and a tensile strength of not less than 110 MPa, and is accordingly of high electrical conductivity, high toughness, and high strength and also excellent in impact resistance and high in connection strength with a terminal portion. In particular, from a comparison between samples with the same composition, it is seen that a sample having undergone the batch softening treatment is superior to a sample having undergone the continuous softening treatment, in terms of electrical conductivity and mechanical characteristics such as elongation, strength, and impact resistance. In contrast, from a comparison between samples with the same composition, it is seen that the sample having undergone the continuous softening treatment is smaller in the absolute value of the pitting potential and the absolute value of the protective potential and superior in corrosion resistance as compared with the sample having undergone the batch softening treatment. Further, from a comparison for example between Sample No. 15 and Sample No. 16 in Table 5, it is seen that, of the samples that are almost identical in tensile strength, the sample having a higher 0.2% proof stress tends to have a higher terminal securing strength.

As described above, a covered electric wire for which an Al alloy wire made of an Al—Fe-based alloy with a specific composition and having been softening-treated is used has a high electrical conductivity, a high toughness, and a high strength as well as an excellent connection strength with a terminal portion and an excellent impact resistance as well. Therefore, it is expected that this covered electric wire can be used suitably for a wire harness, particularly for a wire harness for a motor vehicle.

It should be noted that the above-described embodiment may be modified as appropriate without going beyond the scope of the present invention, and is not limited to the above-described structure. For example, the content of Fe, Cu, Mg, Si, Zn, Ni, Mn, Ag, Cr, Zr each may be varied within a specific range. Further, the size and the shape of the wire and the number of wires to form a stranded wire may be changed.

INDUSTRIAL APPLICABILITY

The wire harness of the present invention can suitably be used for applications where lightweight as well as high strength, high toughness, and high electrical conductivity are desired, specifically for a wiring of a motor vehicle, for example. The covered electric wire of the present invention, the aluminum alloy wire of the present invention, or the aluminum stranded wire of the present invention can suitably be used as an electric wire of this wire harness or a conductor for the electric wire. Further, the method of manufacturing an aluminum alloy wire of the present invention can suitably be used for manufacture of the above-described aluminum alloy wire of the present invention.

DESCRIPTION OF THE REFERENCE SIGNS

1 stranded wire; 2 insulating cover layer; 3 terminal portion; S sample; w weight; 20 terminal chuck; 21 wire chuck

The invention claimed is:

1. A covered electric wire for a wire harness, comprising: a conductor formed of an aluminum alloy stranded wire formed by stranding together a plurality of aluminum alloy wires, and an insulating cover, layer formed on an outer periphery of said conductor, said aluminum alloy wire consisting of not less than 0.005% and not more than 2.2% by mass of Fe, less than or equal to 0.2% Ni, less than or equal to 0.3% Si, less than or, equal to 0.2% Cu, and optionally not more than 1.0% by mass in total of at least one additive element selected from the group consisting of Mg, Si, Cu, Zn, Ni, Mn, Ag, Cr, and Zr and a remainder of Al and an impurity, said aluminum alloy wire having an electrical conductivity of not less than 58% IACS, said aluminum alloy wire having an elongation of not less than 10%, said aluminum alloy wire having a tensile strength of not less than 128 MPa and not more than 200 MPa, and said aluminum alloy stranded wire having a terminal securing strength, of not, less than 58 N.

2. The covered electric wire for a wire harness according to claim 1, wherein said aluminum alloy wire has a wire diameter of not less than 0.2 mm and not more than 1.5 mm.

3. The covered electric wire for a wire harness according to the claim 1, wherein said aluminum alloy wire has a 0.2% proof stress of not less than 40 MPa.

4. The covered electric wire for a wire harness according to claim 1, wherein said aluminum alloy wire has not less than 0.005% and not more than 1.0% by mass in total of at least one additive element selected from the group consisting of Mg, Si, Cu, Zn, Ni, Mn, Ag, Cr, and Zr.

5. The covered electric wire for a wire harness according to claim 1, wherein in an observation field of 2400 nm×2600 nm taken from a cross section of said aluminum alloy wire, the number of precipitates present in the observation field and having a circle-equivalent diameter of not more than 100 nm is more than 10.

6. A wire harness comprising a covered electric wire for a wire harness as recited in claim 1, and a terminal portion attached to an end of the covered electric wire.

* * * * *